United States Patent [19]

Carr

[11] 4,338,276

[45] Jul. 6, 1982

[54] PROCESS FOR THE MANUFACTURE OF POLYAMIDE YARNS

[75] Inventor: Paul L. I. Carr, Harrogate, England

[73] Assignee: Imperial Chemical Industries, Ltd., London, England

[21] Appl. No.: 171,671

[22] Filed: Jul. 24, 1980

Related U.S. Application Data

[63] Continuation of Ser. No. 934,916, Aug. 18, 1978, abandoned.

[30] Foreign Application Priority Data

Aug. 19, 1977 [GB] United Kingdom ..... 34906/77

[51] Int. Cl.[3] ..... D01D 1/04

[52] U.S. Cl. ..... 264/176 F; 264/237

[58] Field of Search ..... 264/176 F, 210.8, 237

[56] References Cited

U.S. PATENT DOCUMENTS

| | | | |
|---|---|---|---|
| 3,053,611 | 9/1962 | Griehl | 264/176 F |
| 3,361,859 | 1/1968 | Cenzato | 264/210.8 |
| 3,707,593 | 12/1972 | Fukada et al. | 264/176 F |
| 3,907,957 | 9/1975 | Shaffer | 264/176 F |
| 3,946,100 | 3/1976 | Davis et al. | 264/210.8 |
| 3,994,121 | 11/1976 | Adams | 264/210.8 |
| 4,045,534 | 8/1977 | Fisher et al. | 264/176 F |
| 4,093,147 | 6/1978 | Bromley et al. | 264/210.8 |
| 4,134,882 | 1/1979 | Frankfort et al. | 264/176 F |
| 4,181,697 | 1/1980 | Koschinek et al. | 264/176 F |

FOREIGN PATENT DOCUMENTS

| | | | |
|---|---|---|---|
| 763339 | 7/1967 | Canada | 264/176 F |
| 48-1421 | 1/1973 | Japan | 264/210.8 |

*Primary Examiner*—Jay H. Woo

*Attorney, Agent, or Firm*—Herbert M. Adrian, Jr.

[57] ABSTRACT

Manufacture of polyamide yarns by a high speed draw spinning process in which the yarns are passed through defined fluid environments. Yarns are comparable in properties with conventional spin-lag-draw yarns.

6 Claims, No Drawings

PROCESS FOR THE MANUFACTURE OF POLYAMIDE YARNS

This is a continuation-in-part of Ser. No. 934,916 filed Aug. 18, 1978 and now abandoned.

The present invention relates to draw spinning processes for the manufacture of filamentary polyamide yarns, and in particular to high speed single stage draw spinning processes for the manufacture of yarns which have properties comparable with those hitherto obtainable only by immediate speed single stage processes or two-stage spin-lag-draw processes.

It has been proposed, for example according to UK patent specification No. 1 487 843, that multifilament polyester yarns may be advantageously formed by processes in which under certain defined conditions freshly extruded filaments are passed sequentially through solidification and conditioning zones and wound up at speeds between 1000 and 6000 meters/minute. It has also been proposed that multifilament polyamide yarns may be advantageously formed by such processes, but in the practice of these processes, it has been found that yarn properties, especially yarn mechanical properties, begin to deteriorate as the wind-up speed is increased above about 5500 meters/minute. In particular the number of broken filaments occurring in the yarn increases until ultimately the yarn breaks, and in the case of low decitex filament yarns where broken filaments are more likely to occur, this limitation has been found to be particularly serious.

In the present invention these deficiencies have been substantially overcome and it is now possible not only to maintain useful and desirable yarn properties up to wind up speeds of 6000 meters/minute, but to further increase wind up speeds and thereby spinning productivity without significant deterioration in yarn properties. High decitex filament yarns have derived especial benefit from this invention.

Accordingly, the present invention provides a draw spinning process for the manufacture of filamentary polyamide yarns in which freshly extruded filaments are passed sequentially through a first fluid environment heated to a temperature above the melting point of the filaments and a second fluid environment heated to a temperature of 80° C. to 250° C., and subsequently winding-up the filaments at a speed in excess of 5500 meters/minute.

Preferably, the first fluid environment is heated to a temperature between the melting point of the filaments (in the range 260° C.–270° C.) and 350° C. (measured as described in Example 1) and the second fluid environment to a temperature of 100° C. to 150° C. The two environments are separated from one another by a short distance, advantageously by between 100 cm and 500 cm. The distance selected is sufficient to cool the fibres below the temperature of the second fluid environment.

Desirably the fluid is air, though nitrogen may also be mentioned. Significantly, the present invention does not involve the use of steam which is traditionally associated with the manufacture of filamentary polyamide yarns.

Winding-up speeds are preferably in excess of 6000 meters/minute. Speeds above 8000 meters/minute are considered difficult to operate commercially and are not preferred.

The first heated fluid (air) environment through which the filaments are passed may be conveniently defined by means of an electrically heated vertically disposed cylindrical metal shroud of sufficient diameter to accommodate the travelling filaments, one end of which is sealed to the spinneret face. The length of the shroud is not critical and may be up to 100 cm, though shorter length shrouds are preferred. The second heated fluid (air) environment through which the filaments pass may conveniently take the form of an electrically heated elongate tube of circular cross-section which is mounted vertically between the shroud and the wind up means. The diameter of the tube should be sufficient to accommodate the travelling filaments and may be from 30 cm to 3 meters in length. Preferably, the length of the tube is about 1 meter. Air in the tube may remain static but for turbulence caused by the moving filaments, or heated air may be deliberately introduced into the tube (usually from a point at the downstream end thereof).

By way of illustration only of the present invention the following examples are provided:

EXAMPLE 1 (According to the invention)

A 78 dtex 20 filament yarn was spun from polyhexamethylene adipamide polymer at a temperature of 285° C. through a 20 hole spinneret with 0.009 inch diameter orifices. The relative viscosity of the resulting filaments was 40.5. Beneath the spinneret (point of extrusion) and sealed to it was a 30 cm long electrically heated cylindrical metal shroud with an internal diameter of 10 cm. The mean air temperature within the shroud, measured by thermocouples placed 2 cm from the inside wall, was 310° C. An electrically heated elongate static air tube of circular cross-section, 1 meter in length and 5 cm in diameter, was mounted vertically below the heated shroud and approximately 1.9 meters below the spinneret. The mean wall temperature of the tube (measured by thermocouples) was 110° C. A pair of cylindrical guides were mounted at the yarn entrance to the tube to converge and ribbon the filaments, and minimise cold air entrainment. Yarn tensioning guides, as such, were absent. The yarn was wound up after a lubricating finish had been applied at various speeds between 4000 and 7000 m/min and the following yarn properties were obtained. These illustrate the effect of the invention as the wind-up speed is raised to 6000 m/min and above. ie no significant deterioration in yarn properties occurs as the wind up speed is increased. Indeed, at 7000 m/min yarn properties have noticeably improved, especially in respect of modulus. Generally speaking the modulus of the yarn may be said to reflect its degree of wash fastness after dyeing. In the present instant yarns wound up at speeds of 6000 m/min and above were found to possess acceptable wash fastness while those wound up at 5000 m/min and below were unacceptable.

The processes at 6000 m/min and 7000 m/min also ran well with no more broken filaments experienced than at the lower speeds reported in the Table.

| WIND UP SPEED M/MIN | TENACITY GMS/DTEX | EXTENSION % | 5% MODULUS GMS/DTEX |
|---|---|---|---|
| 4000 | 4.09 | 64 | 17.2 |
| 5000 | 4.33 | 61 | 19.1 |
| 6000 | 4.03 | 47.2 | 21.9 |
| 7000 | 4.68 | 44.4 | 24.0 |

EXAMPLE 2 (According to the invention)

Example 1 was repeated except that the heated shroud beneath the spinneret was reduced in length to 10 cm and the mean air temperature therein (measured as in Example 1) increased to 400° C. The tube temperature was also increased to 130° C. Corresponding results were as follows:

| WIND UP SPEED M/MIN | TENACITY GMS/DTEX | EXTENSION % | 5% MODULUS GMS/DTEX |
|---|---|---|---|
| 4000 | 3.52 | 69.7 | 15.9 |
| 5000 | 3.73 | 75.0 | 14.2 |
| 5500 | 3.91 | 69.0 | 19.6 |
| 6000 | 4.11 | 50.9 | 24.8 |

Thus, in terms of tenacity and modulus a shorter length, higher temperature shroud in combination with a higher tube temperature is preferred at 6000 m/min.

EXAMPLE 3 (Two stage spin-lag-draw prior art process)

A 130 dtex 13 filament yarn was spun from polyhexamethylene adipamide polymer at a temperature of 286° C. through a 13 hole spinneret with 0.013 inch diameter orifices. The filaments were cooled using a cross-flow quenching device 60 cm long and 11 cm wide supplying 90 cubic feet/minute of air at ambient temperature. The filaments were then passed through a tube similar to that described in the previous Example which was filled with steam, and were wound up at 1180 m/min.

In a separate drawing process the yarn was cold drawn 2.93 times to give a 44 dtex yarn. The draw roll speed was 1230 m/min.

The yarn had the following properties:

Tenacity 4.2 gm/dtex;

Extension 41.0%.

EXAMPLE 4 (Single-stage prior art process)

Example 2 was repeated except that the 10 cm long shroud fitted beneath the spinneret was removed, ie only a heated tube was present. Corresponding results were as follows:

| WIND UP SPEED M/MIN | TENACITY GMS/DTEX | EXTENSION % | 5% MODULUS GMS/DTEX |
|---|---|---|---|
| 4000 | 4.05 | 64.9 | 20.6 |
| 5000 | 3.58 | 74.0 | 16.9 |
| 5500 | 3.50 | 61.8 | 18.6 |

-continued

| WIND UP SPEED M/MIN | TENACITY GMS/DTEX | EXTENSION % | 5% MODULUS GMS/DTEX |
|---|---|---|---|
| 6000 | 3.52 | 54.0 | 20.4 |

Thus, it was not possible to achieve yarn properties similar to those reported in Example 2 merely by employing a heated tube in the absence of a heated shroud.

EXAMPLE 5 (Single-stage process derived from the prior art)

Yarn was spun under the same conditions described in Example 1 except that the heated shroud was replaced by a cross-flow quench similar to that described in Example 3. The quench velocity was 25 meters/minute. Comparative yarn properties were as follows:

| WIND UP SPEED M/MIN | TENACITY GMS/DTEX | EXTENSION % | 5% MODULUS GMS/DTEX |
|---|---|---|---|
| 3000 | 2.85 | 89.6 | 13.0 |
| 4000 | 3.64 | 73.2 | 13.7 |
| 5000 | 3.72 | 65.6 | 15.8 |
| 6000 | 4.05 | 56.2 | 19.8 |
| 6500 | Yarn Breaks | | |

Thus, it was not possible to achieve yarn properties similar to those reported in Example 1 merely by employing a known cross-flow quench at the higher wind-up speeds of the present invention.

I claim:

1. A draw spinning process for the manufacture of filamentary polyamide yarns comprising directly extruding molten polyamide filaments into a first fluid environment heated to a temperature above the melting point of the filaments and subsequently passing said filaments through a second fluid environment heated to a temperature of 80° C. to 250° C.; said fluid environment being separated from one another a distance sufficient to cool the filaments below the temperature of the second fluid environment, and withdrawing and winding up said filaments at a speed in excess of 5500 meters/minute.

2. A process according to claim 1 in which the fluid environments are separated by between 100 cm and 500 cm.

3. A process according to claim 1 in which the first fluid environment is heated to a temperature between the melting point of the filaments and 350° C.

4. A process according to claim 1 in which the second fluid environment is heated to a temperature of 100° C. to 150° C.

5. A process according to claim 1 in which the fluid environment is air.

6. A process according to claim 1 in which the filaments are wound up at a speed in excess of 6000 meters/minute.

* * * * *